US007187115B2

(12) United States Patent
Seon

(10) Patent No.: US 7,187,115 B2
(45) Date of Patent: Mar. 6, 2007

(54) ELECTRON EMISSION DEVICE

(75) Inventor: Hyeong-Rae Seon, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/153,714

(22) Filed: Jun. 14, 2005

(65) Prior Publication Data

US 2005/0280350 A1 Dec. 22, 2005

(30) Foreign Application Priority Data

Jun. 18, 2004 (KR) ..... 10-2004-0045463

(51) Int. Cl.
*H01J 1/88* (2006.01)
*H01J 1/00* (2006.01)

(52) U.S. Cl. ..... 313/496; 313/292; 313/238

(58) Field of Classification Search ..... 313/496, 313/495, 497, 309, 310, 311, 336, 351, 292, 313/238

See application file for complete search history.

(56) References Cited

U.S. PATENT DOCUMENTS 6,342,754 B1 * 1/2002 Kuroda et al. ..... 313/292
6,891,320 B2 * 5/2005 Nakamoto ..... 313/311
2003/0197459 A1 * 10/2003 Takenaka et al. ..... 313/422
2004/0135493 A1 * 7/2004 Park et al. ..... 313/497

FOREIGN PATENT DOCUMENTS

KR 2001081496 A * 8/2001

OTHER PUBLICATIONS

Geometric Dimensioning and Tolerancing Definitions: http://www.engineersedge.com/gdt.htm.*

* cited by examiner

*Primary Examiner*—Mariceli Santiago
*Assistant Examiner*—Anne M Hines
(74) *Attorney, Agent, or Firm*—Christie, Parker & Hale, LLP

(57) ABSTRACT

An electron emission display device includes first and second substrates facing each other with a predetermined distance therebetween, an electron emission unit formed at the first substrate, and an image display unit formed at the second substrate. A grid electrode is disposed between the first and the second substrates and has a plurality of beam guide holes arranged in a first predetermined pattern, and spacer insertion holes arranged in a second predetermined pattern. Spacers are inserted into the respective spacer insertion holes of the grid electrode, and are fitted between the first and the second substrates. The size of each of the spacer insertion holes is larger than the outer size of each of the spacers.

14 Claims, 5 Drawing Sheets

ELECTRON EMISSION DEVICE

CROSS-REFERENCE TO RELATED APPLICATION

This application claims the benefit of and priority to Korean Patent Application No. 10-2004-0045463 filed on Jun. 18, 2004 in the Korean Intellectual Property Office, the entire content of which is incorporated herein by reference.

BACKGROUND

1. Field of the Invention

The present invention relates to an electron emission device, and in particular, to an electron emission device having cathode and anode electrodes, and a grid electrode disposed between the cathode and anode electrodes.

2. Description of Related Art

Generally, electron emission devices can be classified into two types. A first type uses a hot cathode as an electron emission source, and a second type uses a cold cathode as the electron emission source. Also, in the second type of electron emission devices, there are a field emission array (FEA) type, a surface conduction emitter (SCE) type, a metal-insulator-metal (MIM) type, a metal-insulator-semiconductor (MIS) type, and a ballistic electron surface emitter (BSE) type.

Although the electron emission devices are differentiated in their specific structure depending upon the types thereof, they all basically have an electron emission unit placed within a vacuum vessel to emit electrons, which strike phosphors on a phosphor layer to emit light. The electron emission device is employed for use in making a display apparatus, or other electronic appliances.

When the electron emission device displays a full-colored image with red, green, and blue phosphors, the electrons emitted from the electron emission unit at a specific pixel region should be focused on the correct phosphors at the relevant pixel while not being dispersed toward the incorrect phosphors at other pixels. Because of this, a metal mesh-shaped grid electrode is conventionally provided within the vacuum vessel forming the electron emission device.

The grid electrode has a structure where a plurality of electron beam guide holes are formed at a metallic plate by way of etching. The grid electrode is fitted between a first substrate with lower spacers and a second substrate with upper spacers.

However, with the electron emission device having the above-structured grid electrode, as the spacers are separately arranged below and above the grid electrode and are internally adhered to the vacuum vessel using an adhesive material, extra time and cost are consumed in installing these spacers, resulting in poor productivity.

Furthermore, with the conventional electron emission device, it is very difficult to attach the spacers to predetermined locations in a constant manner, and the spacers are likely to be displaced from the proper locations, and/or to be inclined. If the spacers are displaced and/or inclined, the support structure between the first and the second substrates is non-balanced, and is likely to be broken during the exhaust process.

In addition, with the conventional electron emission device, the spacers are installed using an adhesive material. When the adhesive material is partially vaporized during the sealing and exhaust processes while generating gas, it detrimentally affects the vacuum degree, and the vaporized gas needs to be exhausted.

SUMMARY OF THE INVENTION

In accordance with the present invention, an electron emission device is formed with spacer insertion holes at a grid electrode to make spacers installation easy and stable without using an adhesive material.

An exemplary electron emission device according to one embodiment of the present invention includes first and second substrates facing each other with a predetermined distance therebetween, an electron emission unit formed at the first substrate, and an image display unit formed at the second substrate. A grid electrode is disposed between the first and the second substrates and has a plurality of beam guide holes arranged in a first predetermined pattern, and a plurality of spacer insertion holes arranged in a second predetermined pattern. A plurality of spacers are inserted into the respective spacer insertion holes of the grid electrode, and fitted between the first and the second substrates. A size of each of the spacer insertion holes is larger than an outer size of each of the spacers.

The size of at least one of the spacer insertion holes may be dimensioned such that there is a clearance fit with the outer size of at least one of the spacers.

The size of at least one of the spacer insertion holes may be dimensioned such that there is a transition fit with the outer size of at least one of the spacers.

At least one of the spacer insertion holes may be outlined with a sectional shape of at lest one of the spacers, and the at least one of the spacers may include a solid piece having a cross section in a shape of a triangle, a rectangle, a pentagon, a hexagon, a polygon, a circle, an oval, a criss-cross, and/or a star.

The grid electrode is a metal mesh. An insulating layer may be formed on a bottom surface of the metal mesh through depositing an insulating material to a predetermined height.

A fixation layer may be formed on a bottom surface of the insulating layer through depositing a frit. The insulating layer and the fixation layer placed under the metal mesh may be formed at least around each of the spacer insertion holes.

The electron emission unit may include first and second electrodes formed on the first substrate and being insulated from each other, and electron emission regions connected to at least one of the first and the second electrodes.

A total height of the insulating layer and the fixation layer placed under the metal mesh may be dimensioned to correspond to a distance between the electron emission unit and the grid electrode.

The electron emitter material may include graphite, diamond, diamond-like carbon, carbon nanotube, $C_{60}$, graphite nanofiber and/or silicon nanowire.

The first electrodes may be arranged on the first substrate with a predetermined distance therebetween, the second electrodes may cross over the first electrodes, and an insulating layer may be interposed therebetween. The electron emission regions may be formed at the crossed portions of the first electrodes with the second electrodes.

At least one of the first electrodes and at least a corresponding one of the second electrodes may be arranged on the first substrate with a predetermined distance therebetween. A first conductive layer may partially cover the at least one of the first electrodes, and a second conductive layer may partially cover the at least corresponding one of the second electrodes. At least one of the electron emission regions may be formed between the first conductive layer and the second conductive layer while being connected to the first conductive layer and the second conductive layer.

The image display unit may have an anode electrode formed on the second substrate, and a phosphor layer may be formed on the anode electrode with a third predetermined pattern.

DETAILED DESCRIPTION

Figure 1:
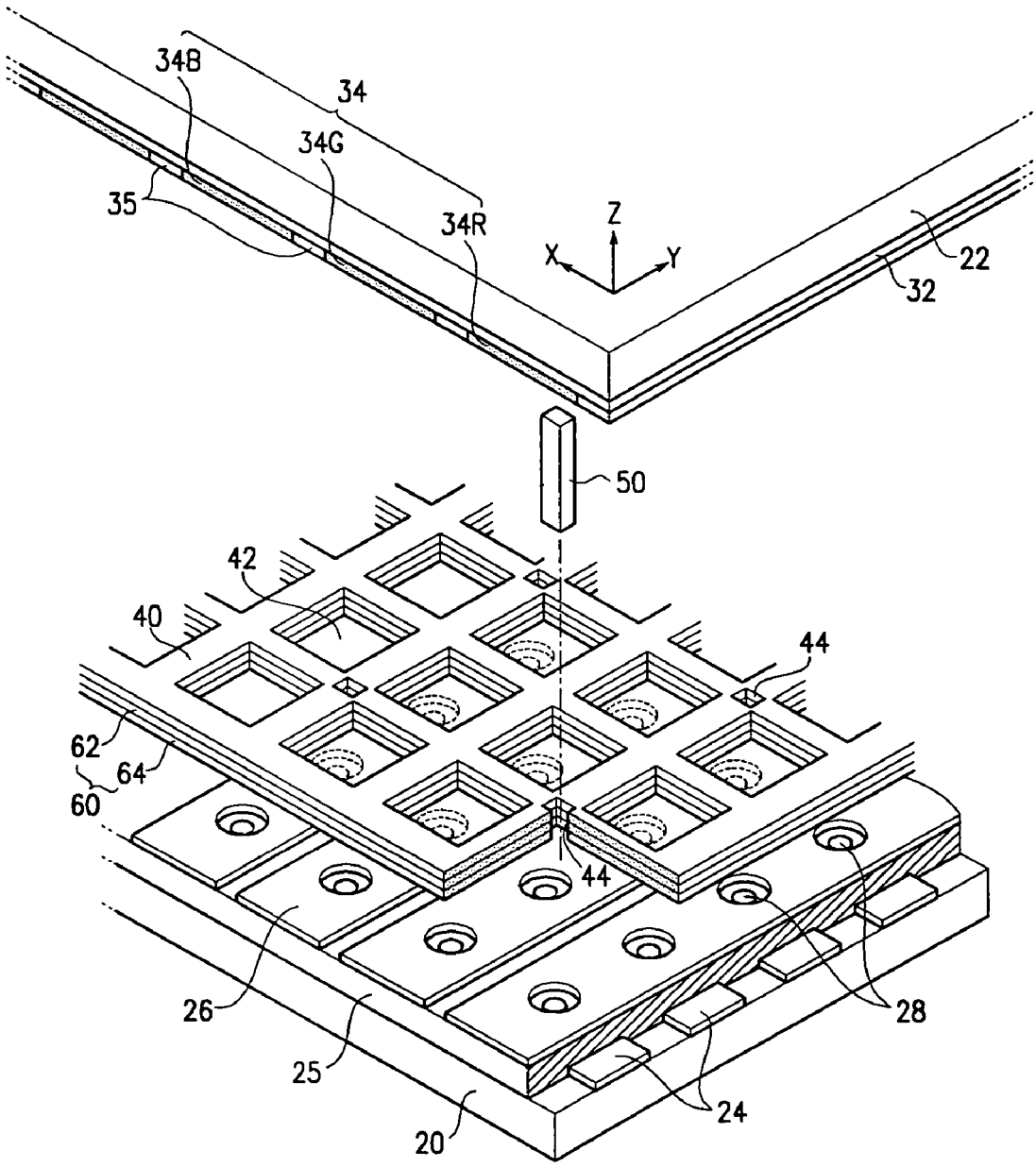
FIG. 1 is a partially amplified and exploded perspective view of an electron emission device according to an embodiment of the present invention.
Figure 2:
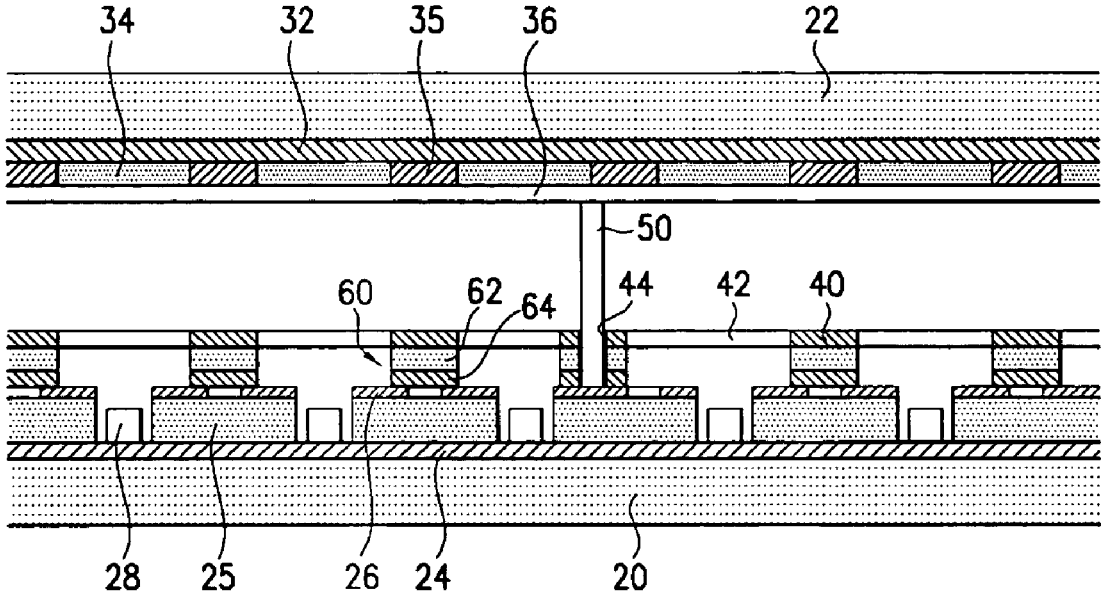
FIG. 2 is a partially amplified sectional view of the electron emission device according to the embodiment of the present invention.
Figure 3:
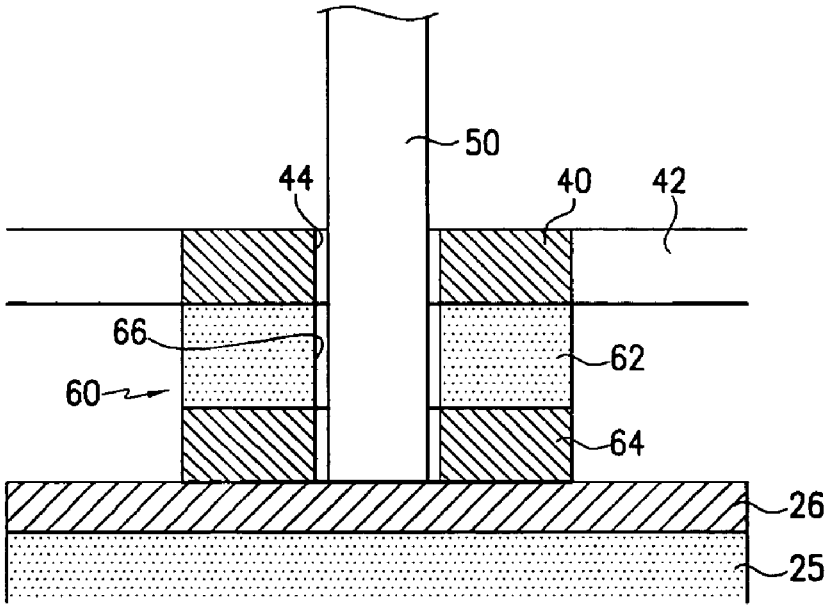
FIG. 3 is a partially amplified sectional view of a spacer for the electron emission device according to the embodiment of the present invention.
Figure 6:
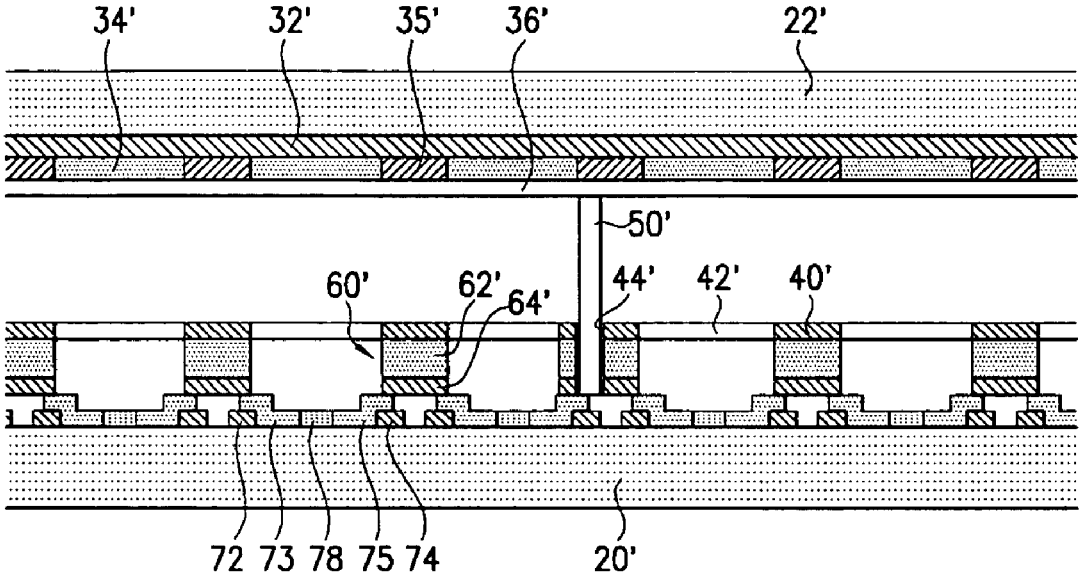
FIG. 6 is a partially amplified sectional view of an electron emission device according to another embodiment of the present invention.
Figure 7A:
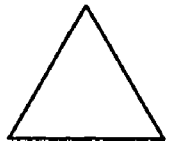
FIGS. 7A, 7B, 7C, 7D, 7E, and 7F are sectional views of emboidments of a spacer.
Figure 7B:
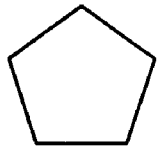
Figure 7C:
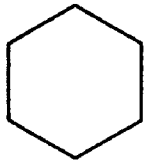
Figure 7D:
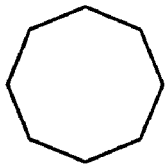
Figure 7E:
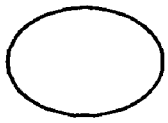
Figure 7F:
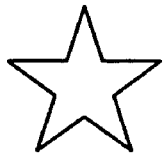

FIGS. 1 to 3 illustrate an FEA-type of electron emission device, and FIG. 6 illustrates an SCE-type of electron emission device.

As shown in FIGS. 1 and 2, the electron emission device includes first and second substrates 20, 22 facing each other with a predetermined distance therebetween to form a vacuum vessel. An electron emission unit is provided at the first substrate 20 to emit electrons, and an image display unit is provided at the second substrate 22 to emit light due to the electrons, thereby displaying the desired images.

The electron emission unit includes a plurality of first electrodes 24 formed on the first substrate 20 as cathode electrodes while being spaced apart from each other by a predetermined distance, and a plurality of second electrodes 26 crossing over the first electrodes 24 as gate electrodes. An insulating layer 25 is interposed between the first electrodes 24 and the second electrodes 26, and electron emission regions 28 are formed on the crossed portions of the first electrodes 26 with the second electrodes 26.

Furthermore, in this embodiment, the image display unit includes an anode electrode 32 formed on the second substrate 22, and a phosphor layer 34 formed on the anode electrode 32 with a predetermined pattern.

A grid electrode 40 is disposed between the first and the second substrates 20, 22 with a plurality of beam guide holes 42 arranged in a first predetermined pattern, and spacer insertion holes 44 arranged in a second predetermined pattern.

Spacers 50 are inserted into the spacer insertion holes 44 of the grid electrode 40, and fitted between the first and the second substrates 20, 22.

The first and the second electrodes 24, 26 are formed with a stripe pattern, and are arranged perpendicularly to each other. For instance, the first electrodes 24 are stripe-patterned in the direction of an X axis of FIG. 1, and the second electrodes 26 are stripe-patterned in the direction of an Y axis of FIG. 1.

The insulating layer 25 is formed on the entire area of the first substrate 20 between the first and the second electrodes 24, 26.

A portion of the insulating layer 25 and the second electrodes 26 at the respective crossed regions of the first and the second electrodes 24, 26 are partially removed to thereby expose portions of the first electrodes 24. The electron emission regions 28 are formed on the exposed portions of the first electrodes 24.

The electron emission regions 28 are formed with a carbon-based material suitable for emitting electrons under a driving condition of low voltages ranging from about 10V to 100V.

The carbon-based material for forming the electron emission regions 28 is selected from graphite, diamond, diamond-like carbon (DLC), carbon nanotube (CNT), and/or $C_{60}$ (fullerene). In particular, a carbon nanotube is known in the art as an ideal emitter material because the terminal curvature radius thereof is several to several tens of nanometers in size, and the material remains an excellent electron emitter even at low electric fields of about 1 to 10V/μm.

The electron emission regions 28 may also be formed with a nano-sized material, such as carbon nanotube, graphite nanofiber, and/or silicon nanowire.

The electron emission regions 28 may be formed with various shapes, such as a cone, a wedge, and a thin film edge.

It is explained above that a first electrode 24 is formed on the first substrate 20 as a cathode electrode, and a second electrode 26 is placed over the first electrode 24 as a gate electrode while the insulating layer 25 is interposed therebetween. Alternatively (not shown), it is also possible that the second electrode 26 is formed on the first substrate 20 as a gate electrode, and the first electrode 24 is placed over the second electrode 26 as a cathode electrode while the insulating layer 25 is interposed therebetween. In this alternative case, a direct electron emitter 28 is formed on the crossed portion of the first electrode 24 with the second electrode 26.

Referring still to FIGS. 1 and 2, the anode electrode 32 formed on the second substrate 22 is formed with a high light transmittance transparent electrode, such as indium tin oxide (ITO).

The phosphor layer 34 formed on the second substrate 22 has a red phosphor layer portion 34R, a green phosphor layer portion 34G, and a blue phosphor layer portion 34B sequentially and alternately arranged in the direction of a second electrode 26 (in the direction of the Y axis of FIG. 1), while being spaced apart from each other by a predetermined distance.

A dark layer 35 is formed between the respective phosphor layer portions 34R, 34G, 34B to enhance the contrast.

As shown in FIG. 2, a metallic thin film 36 is formed on the phosphor layer 34 and the dark layer 35. The metallic thin film 36 can be formed from aluminum. The metallic thin film 36 serves to enhance the withstand voltage characteristic and the brightness.

Alternatively, it is also possible that the phosphor layer 34 and the dark layer 35 are directly formed on the second substrate 22 (not shown) while being overlaid with a metallic thin film 36. In this case, the metallic thin film 36 functions as an anode electrode under the application of a high voltage. As compared to the structure where the anode electrode 32 is formed on the second substrate 22 with a transparent electrode material, the metallic thin film 36 can endure higher voltage, and effectively serve to enhance the screen brightness.

The above-structured first and second substrates 20, 22 are aligned with each other with a predetermined distance therebetween such that the first electrode 24 and the phosphor layer 34 proceed perpendicular to each other, and are sealed to each other with a sealant (not shown). The internal space between the first and the second substrates 20, 22 is exhausted to maintain a vacuum state.

In order to keep the distance between the first and the second substrates 20, 22 constant, spacers 50 are arranged between the first and the second substrates 20, 22 while being spaced apart from each other by a predetermined distance. In one embodiment, the spacers 50 are displaced from the locations of pixels and the passage routes of electron beams.

As shown in FIG. 2, the spacers 50 pass through the spacer insertion holes 44 formed at the grid electrode 40, and support the first and the second substrates 20, 22 such that they are spaced apart from each other by a predetermined distance. In this embodiment, the grid electrode 40 is formed with a thin metallic sheet having insertion holes 44, that is, with a metal mesh.

The spacer insertion holes 44 are outlined with the sectional shape of the spacers 50.

The spacer insertion holes 44 are dimensioned such that they are not changed with the inserting of the spacer 50. That is, the size of a spacer insertion hole 44 is established such that there is a transition or clearance fit with the outer size of the spacer 50, or a transition fit thereto. That is, when the size of the spacer insertion hole 44 is established to be smaller than the outer size of the spacer 50 or when there is a tight or interference-fitting thereto, the spacer 50 is not fluently inserted into the insertion hole 44, and as a result, the bottom or top end of the spacer 50 may not properly be in contact with the first substrate 20 or the second substrate 22. Because the bottom or top end of the spacer 50 may not properly contact the first substrate 20 or the second substrate 22, during the process of sealing and exhausting the first and the second substrates 20, 22, the grid electrode 40 may be in contact with the spacer 50 therein such that the grid electrode 40 can be partially deformed so that beam focusing is distorted, or the first and the second substrates 20, 22 may be loose. Accordingly, the size of the spacer insertion hole 44 should be larger than that of the spacer 50 to allow some leeway.

As shown in FIG. 1, the spacer 50 is formed as a solid piece having a cross section of a rectangle.

Figure 4:
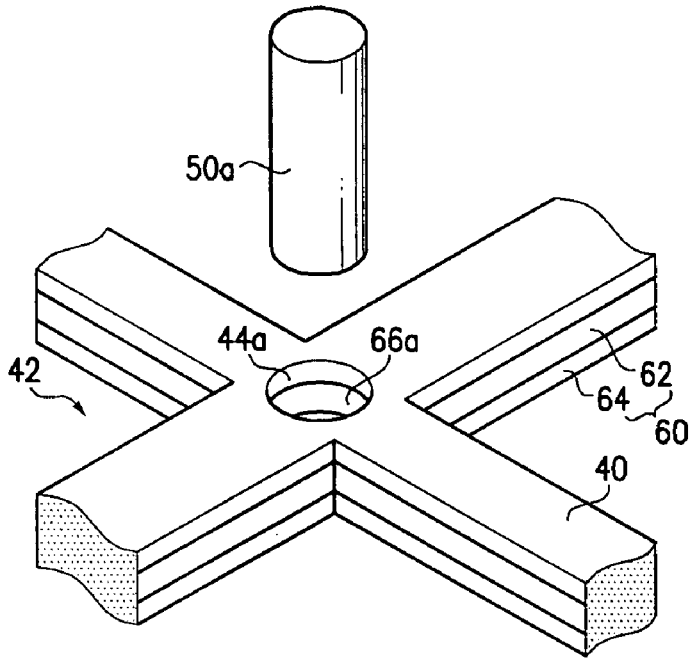
FIG. 4 is a partially amplified and exploded perspective view of a variant of the spacer for the electron emission device according to the embodiment of the present invention.
Figure 5:
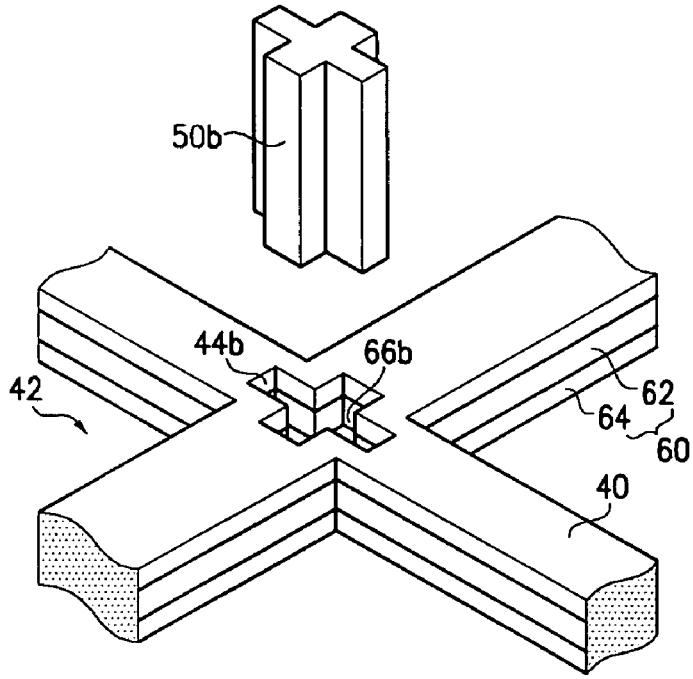
FIG. 5 is a partially amplified and exploded perspective view of another variant of the spacer for the electron emission device according to the embodiment of the present invention.

Alternatively, a spacer 50*a* may be shaped as a cylinder to be inserted into a corresponding spacer insertion hole 44*a* and a corresponding supporting layer insertion hole 66*a* as shown in FIG. 4, or a spacer 50*b* may be shaped as a solid piece having a crisscross section to be inserted into a corresponding spacer insertion hole 44*b* and a corresponding supporting layer insertion hole 66*b* as shown in FIG. 5.

Furthermore, as shown in FIGS. 7A through 7F, the spacer 50 may be shaped as a solid piece with a cross section in a shape of a triangle, a pentagon, a hexagon, a polygon, an oval, a star, etc.

When the first and the second substrates 20, 22 are sealed with each other while the spacers 50 are inserted into the spacer insertion holes 44 of the grid electrode 40, the spacers 50 are fixedly self-standing. Accordingly, the spacers 50 are not displaced from the proper locations, or tilted even if they are not adhered to the first and the second substrates 20, 22 by using an adhesive material.

As shown in FIG. 3, to reduce the charging of the electron beams with a spacer 50, the bottom end of the spacer 50 contacts a second electrode 26 that functions as a gate electrode. That is, when the bottom ends of the spacers 50 are in contact with the second electrodes 26, the charging of the electron beams emitted from the electron emission regions 28 toward the anode electrode 32 and partially colliding against the spacers 50 is significantly reduced due to the effect of the second electrodes 26.

As shown in FIGS. 1 to 3, a support layer 60 is formed on the bottom surface of the grid electrode 40. The support layer 60 has an insulating layer 62 formed through depositing an insulating material to a predetermined height. The height of the insulating layer 62 can be established such that the distance between the grid electrode 40 and a first electrode 24 being a cathode electrode can be maintained in a predetermined manner. The support layer 60 also has a fixation layer 64 formed through depositing a frit onto the bottom surface of the insulating layer 62.

As described above, the support layer 60 with the insulating layer 62 and the fixation layer 64 is formed on the bottom surface of the grid electrode 40, and the grid electrode 40 is placed on the first substrate 20. In this state, when the fixation layer 64 is fired and hardened, the grid electrode 40 is combined with the first substrate 20 in a body so that it is not required to install a separate support member.

When the grid electrode 40 is combined with the first substrate 20 in a body, the spacers 50 are inserted into the spacer insertion holes 44, and the first and the second substrates 20 and 22 are sealed to each other.

The insulating layer 62 formed on the bottom surface of the grid electrode 40 prevents the grid electrode 40 from being short-circuited with the second electrode 26 and/or the first electrode 24.

The height of the support layer 60 with the insulating layer 62 and the fixation layer 64 is controlled to properly maintain the distance between the first electrode 24 being the cathode electrode and the grid electrode 40 in an optimal manner.

The support layer 60 with the insulating layer 62 and the fixation layer 64 may be wholly formed at the area with no beam guide hole 42, or locally formed in a predetermined manner.

Furthermore, in one embodiment, the support layer 60 with the insulating layer 62 and the fixation layer 64 is at least formed around the spacer insertion holes 44 via corresponding supporting layer insertion holes 66 to securely prevent the spacers 50 from shifting, and to enhance the support endurance thereof.

As shown in FIG. 6, an electron emission device according to another embodiment of the present invention includes first and second substrates 20', 22' facing each other with a predetermined distance therebetween, an electron emission unit formed at the first substrate 20', and an image display unit formed at the second substrate 22'. The electron emission unit has first and second electrodes 72, 74 arranged on the first substrate 20' at a predetermined distance while facing each other, and electron emission regions 78 connected to the first and the second electrodes 72, 74. The image display unit has an anode electrode 32' formed on the second substrate 22', and a phosphor layer 34' formed on the anode electrode 32' with a predetermined pattern. A dark layer 35' is formed between the respective phosphor layer portions of the phosphor layer 34' and a metallic thin film 36' is formed on the phosphor layer 34' and the dark layer 35'.

A grid electrode 40' is disposed between the first and the second substrates 20', 22' with a plurality of beam guide holes 42' arranged in a first predetermined pattern and spacer insertion holes 44' arranged in a second predetermined pattern. Spacers 50' are inserted into the spacer insertion holes 44' of the grid electrode 40', and are fitted between the first and the second substrates 20', 22'.

The first and the second electrodes 72, 74 are respectively formed on the first substrate 20' while standing at substantially the same plane.

First and second conductive layers 73, 75 are respectively formed on the first and the second electrodes 72, 74 such that they partially cover these electrodes 72, 74 while coming closer to each other. Electron emission regions are formed between the first and the second conductive layers 73, 75 placed close to each other while being connected to the conductive layers 73, 75. Accordingly, the electron emission regions 78 are electrically connected to the first and the second electrodes 72, 74 through the first and the second conductive layers 73, 75.

When voltages are applied to the first and the second electrodes 72, 74, an electric current flows through the first and the second conductive layers 73, 75 while proceeding in parallel with the surface of the small-sized thin film electron emission regions 78, thereby causing the surface conduction electron emitting effect to occur.

The distance between the first and the second electrodes 72, 74 is established to be from several tens of nanometers to several hundreds of micrometers.

The first and the second electrodes 72, 74 are formed with an electrically conductive material, including metals, such as nickel (Ni), chromium (Cr), gold (Au), molybdenum (Mo), tungsten (W), platinum (Pt), titanium (Ti), aluminum (Al), copper (Cu), palladium (Pd), and silver (Ag), and alloys thereof; a printed conductor with a metallic oxide; and/or a transparent electrode, such as ITO.

The first and the second conductive layers 73, 75 are formed with a particulate thin film based on a conductive material, such as nickel (Ni), gold (Au), platinum (Pt), and/or palladium (Pd).

The electron emitter 78 should be formed with a graphitic carbon, or a carbonic compound. As with the structure related to the embodiment of FIGS. 1 to 3, the electron emitter 78 is formed with one, two, or more materials selected from graphite, diamond, diamond-like carbon, carbon nanotube, fullerene ($C_{60}$), and/or with a nanometer-sized material.

In addition, a support layer 60' is formed on the bottom surface of the grid electrode 40'. The support layer 60' has an insulating layer 62' formed through depositing an insulating material to a predetermined height. The height of the insulating layer 62' can be established such that the distance between the grid electrode 40' and the first and the second conductive layers 73, 75 or the first and the second electrodes 72, 74 can be maintained in a predetermined manner. The support layer 60' also has a fixation layer 64' formed through depositing a frit onto the bottom surface of the insulating layer 62'.

In the embodiment of FIG. 6, the other structural components are substantially the same as those related to the embodiment of FIGS. 1 to 3 and, detailed explanation thereof will be omitted.

The specific structure or manufacturing method not illustrated in relation to the embodiments may be realized using various constructions of a common FEA-type electron emission device, or a common SCE-type electron emission device.

Furthermore, the inventive electron emission device structure can be applied for use in making the FEA-type and/or the SCE-type of electron emission devices, as well as in making various other suitable types of electron emission devices using spacers and a grid electrode.

As described above, with an electron emission device of an embodiment of the present invention, spacers are inserted into spacer insertion holes of a grid electrode while maintaining a self-standing state thereof, thereby making the spacer installation possible in an easy and correct manner.

Furthermore, with an electron emission device of an embodiment of the present invention, an adhesive material is not needed for fixing spacers, and hence, an adhesive material vaporized effect during the sealing and the exhausting process, which detrimentally affects the vacuum degree, is prevented.

In addition, with an electron emission device of an embodiment of the present invention, as the bottom end of a spacer contacts a first electrode and/or a second electrode, the charging of electron beams with the spacer is reduced.

Moreover, with an electron emission device of an embodiment of the present invention, an insulating layer and a fixation layer can be formed on the bottom surface of a grid electrode, and the grid electrode is combined with a first substrate in a body, thereby making the installation of the grid electrode possible in a simplified and correct manner.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a first substrate and a second substrate facing each other with a distance therebetween;

an electron emission unit formed at the first substrate;

an image display unit formed at the second substrate;

a grid electrode disposed between the first and the second substrates, the grid electrode having a plurality of beam guide holes arranged in a first predetermined pattern and a plurality of spacer insertion holes arranged in a second predetermined pattern; and a plurality of preformed spacers inserted into and partially out of opposite ends of the respective spacer insertion holes of the grid electrode, and fitted between the first and the second substrates, wherein a size of each of the spacer insertion holes is larger than an outer size of each of the spacers, wherein the grid electrode is a metal mesh, wherein an insulating layer is formed on a bottom surface of the metal mesh through depositing an insulating material to a predetermined height, and wherein a fixation layer is formed on a bottom surface of the insulating layer through depositing a frit.

2. The electron emission device of claim 1, wherein the size of at least one of the spacer insertion holes is dimensioned such that there is a clearance fit with the outer size of at least one of the spacers.

3. The electron emission device of claim 1, wherein the size of at least one of the spacer insertion holes is dimensioned such that there is a transition fit with the outer size of at least one of the spacers.

4. The electron emission device of claim 1, wherein at least one of the spacer insertion holes is outlined with a sectional shape of at least one of the spacers, and the at least one of the spacers comprises a solid piece having a cross section in a shape of a triangle, a rectangle, a pentagon, a hexagon, a polygon, a circle, an oval, a crisscross, and/or a star.

5. The electron emission device of claim 1, wherein the insulating layer and the fixation layer placed under the metal mesh are at least formed around each of the spacer insertion holes.

6. The electron emission device of claim 1, wherein a total height of the insulating layer and the fixation layer placed under the metal mesh is dimensioned to correspond to a desired distance between the electron emission unit and the grid electrode.

7. The electron emission device of claim 1, wherein the electron emission unit comprises an electron emitter and the electron emitter comprises a material formed from graphite, diamond, diamond-like carbon, carbon nanotube, fullerene ($C_{60}$), graphite nanofiber, and/or silicon nanowire.

8. The electron emission device of claim 1, wherein the image display unit comprises an anode electrode formed on the second substrate, and a phosphor layer formed on the anode electrode with a third predetermined pattern.

9. The electron emission device of claim 1, wherein each of the spacers has a first end and a second end, and wherein the outer size of each of the spacers has substantially equal dimension along an entire length from the first end to the second end of each of the spacers.

10. An electron emission device comprising:

a first substrate and a second substrate facing each other with a distance therebetween;

an electron emission unit formed at the first substrate;

an image display unit formed at the second substrate;

a grid electrode disposed between the first and the second substrates, the grid electrode having a plurality of beam guide holes arranged in a first predetermined pattern and a plurality of spacer insertion holes arranged in a second predetermined pattern; and a plurality of preformed spacers inserted into and partially out of opposite ends of the respective spacer insertion holes of the grid electrode, and fitted between the first and the second substrates, wherein a size of each of the spacer insertion holes is larger than an outer size of each of the spacers, wherein the electron emission unit comprises a plurality of first electrodes and a plurality of second electrodes formed on the first substrate and being insulated from each other, and a plurality of electron emission regions connected to at least one of the first electrodes and the second electrodes, and wherein the first electrodes are arranged on the first substrate with a predetermined distance therebetween, the second electrodes cross over the first electrodes, an insulating layer is interposed between the first electrodes and the second electrodes, and the electron emission regions are formed at the crossed portions of the first electrodes with the second electrodes.

11. An electron emission device comprising:

a first substrate and a second substrate facing each other with a distance therebetween;

an electron emission unit formed at the first substrate;

an image display unit formed at the second substrate;

a grid electrode disposed between the first and the second substrates, the grid electrode having a plurality of beam guide holes arranged in a first predetermined pattern and a plurality of spacer insertion holes arranged in a second predetermined pattern; and a plurality of preformed spacers inserted into and partially out of opposite ends of the respective spacer insertion holes of the grid electrode, and fitted between the first and the second substrates, wherein a size of each of the spacer insertion holes is larger than an outer size of each of the spacers, wherein the electron emission unit comprises a plurality of first electrodes and a plurality of second electrodes formed on the first substrate and being insulated from each other, and a plurality of electron emission regions connected to at least one of the first electrodes and the second electrodes, and wherein at least one of the first electrodes and at least a corresponding one of the second electrodes are arranged on the first substrate with a predetermined distance therebetween, a first conductive layer partially covers the at least one of the first electrodes and a second conductive layer partially covers the at least corresponding one of the second electrodes, and at least one of the electron emission regions is formed between the first conductive layer and the second conductive layer while being connected to the first conductive layer and the second conductive layer.

12. An electron emission device comprising:

a first substrate and a second substrate facing each other with a distance therebetween;

an electron emission unit formed at the first substrate;

an image display unit formed at the second substrate;

a grid electrode disposed between the first and the second substrates, the grid electrode having a plurality of beam guide holes arranged in a first predetermined pattern and a plurality of spacer insertion holes arranged in a second predetermined pattern; and a plurality of preformed spacers inserted into and partially out of opposite ends of the respective spacer insertion holes of the grid electrode, and fitted between the first and the second substrates, wherein a size of each of the spacer insertion holes is larger than an outer size of each of the spacers, wherein the image display unit comprises an anode electrode formed on the second substrate, and a phosphor layer formed on the anode electrode with a third predetermined pattern, and wherein the electron emission device further comprises a metallic thin film formed on the phosphor layer.

13. An electron emission device comprising:

a first substrate and a second substrate spaced apart with a distance therebetween;

an electron emission unit formed at the first substrate;

an image display unit formed at the second substrate;

a grid electrode disposed between the first electron emission unit and the image display unit, the grid electrode having a plurality of beam guide holes arranged in a predetermined pattern and a plurality of spacer insertion holes arranged in a second predetermined pattern; and a plurality of spacers inserted into the respective spacer insertion holes of the grid electrode, and fitted between the first and the second substrates, wherein a widest portion along at least one of the spacers is capable of being transition-fitted into a respective one of the spacer insertion holes, and wherein the electron emission unit includes a gate electrode, and wherein at least one of the spacers electrically contacts the gate electrode.

14. The electron emission device of claim 13, wherein the electron emission unit comprises a cathode electrode located on the first substrate and an insulation layer located on the first cathode electrode, and wherein the gate electrode is located over the cathode electrode.

* * * * *